US012279725B1

(12) United States Patent
Weng

(10) Patent No.: US 12,279,725 B1
(45) Date of Patent: Apr. 22, 2025

(54) CHILDREN'S TOILET TRAINER

(71) Applicant: Qi Weng, Zhejiang (CN)

(72) Inventor: Qi Weng, Zhejiang (CN)

( * ) Notice: Subject to any disclaimer, the term of this patent is extended or adjusted under 35 U.S.C. 154(b) by 0 days.

(21) Appl. No.: 18/824,940

(22) Filed: Sep. 5, 2024

(30) Foreign Application Priority Data

Aug. 20, 2024 (CN) ..... 202422033967.1

(51) Int. Cl.
*A47K 11/06* (2006.01)

(52) U.S. Cl.
CPC ..... *A47K 11/06* (2013.01)

(58) Field of Classification Search
CPC . A47C 13/00; A47D 1/04; A47D 1/10; A47K 11/04; A47K 11/06; A47K 13/06; Y10S 4/902
See application file for complete search history.

(56) References Cited

U.S. PATENT DOCUMENTS 4,777,672 A * 10/1988 Gebhard ..... A47K 11/04 297/130
5,161,263 A * 11/1992 Geneve ..... A47K 13/06 4/239
5,787,518 A * 8/1998 Mendelovich ..... A47K 11/04 297/130
11,910,966 B2 * 2/2024 Yang ..... A47C 12/00
2003/0167563 A1 * 9/2003 Hinton ..... A47K 13/005 4/484

FOREIGN PATENT DOCUMENTS

DE 202007002625 * 7/2007 ..... A47K 13/06

* cited by examiner

*Primary Examiner* — David P Angwin
*Assistant Examiner* — Nicholas A Ros

(57) ABSTRACT

The technical solution of this disclosure is a children's toilet trainer, including a toilet seat ring that can hold a potty, the front end of the toilet seat ring is connected to first supporting legs on the left and right sides of the bottom surface, a first pedal is connected between the bottom of the left and right first supporting legs, the bottom of the first supporting legs is hinged to second supporting legs and limits the forward rotation of the second supporting legs, a second pedal is connected between the bottom of the left and right second supporting legs; when the second supporting legs are rotated backward in place relative to the first supporting legs, one end of the second pedal abuts against the bottom surface of the toilet seat ring for positioning.

8 Claims, 7 Drawing Sheets

CHILDREN'S TOILET TRAINER

CROSS REFERENCE TO RELATED APPLICATIONS

The present application claims the benefit of Chinese Patent Application No. 2024220339671 filed on Aug. 20, 2024, the contents of which are incorporated herein by reference in their entirety.

TECHNICAL FIELD

This disclosure relates to the field of toilet trainer technology, particularly to a children's toilet trainer.

BACKGROUND TECHNOLOGY

A children's step toilet trainer is a product designed to be placed directly on an adult toilet for use. When in use, children of appropriate age can place the toilet trainer directly on the adult toilet themselves, then step on the pedal to climb up, turn around and sit on the toilet seat ring to use it. It is used to cultivate children's ability to use the toilet independently and to complete the transition stage from potty to using the toilet.

However, the children's step toilet trainers currently popular in the market have fixed structures with only one mode of use, which is to be mounted on an adult toilet, making them not flexible or convenient enough to use.

SUMMARY OF THE DISCLOSURE

In response to the above problem, this disclosure aims to provide a children's toilet trainer that can be mounted on an adult toilet for young children to climb up and use, and can also be switched to be placed on the ground for young children to sit and use.

The technical solution of this disclosure is a children's toilet trainer, characterized by: including a toilet seat ring that can hold a potty, the front end of the toilet seat ring is connected to first supporting legs on the left and right sides of the bottom surface, a first pedal is connected between the bottom of the left and right first supporting legs, the bottom of the first supporting legs is hinged to second supporting legs and limits the forward rotation of the second supporting legs, a second pedal is connected between the bottom of the left and right second supporting legs; when the second supporting legs are rotated backward in place relative to the first supporting legs, one end of the second pedal abuts against the bottom surface of the toilet seat ring for positioning.

Preferably, the second supporting leg includes two parts: an upper section of the supporting leg and a lower section of the supporting leg. The upper section of the supporting leg has a series of jacks, the bottom of the upper section of the supporting leg is inserted into the lower section of the supporting leg, the lower section of the supporting leg has positioning holes set on the side, a pin shaft is inserted through the positioning holes and jacks to connect the upper and lower sections of the supporting leg together.

Preferably, the top surface of the second pedal extends outward on both sides to form insertion parts, the top surface of the insertion part has a positioning socket cavity, positioning protrusions extend out from the left and right sides of the positioning socket cavity, and the bottom surface of the positioning socket cavity has two positioning grooves set front and back; the bottom of the second supporting leg has jacks corresponding to the positioning protrusions set on both left and right sides, and the bottom surface of the second supporting leg has a positioning bump. When the second supporting leg is inserted into the positioning socket cavity, the positioning bump inserts into the front positioning groove. After the second supporting leg is rotated backward in place relative to the first supporting leg, the second pedal rotates relative to the second supporting leg, and the positioning bump on the bottom surface of the second supporting leg inserts into the rear positioning groove for positioning.

Preferably, the insertion part is located at the rear end on both sides of the top surface of the second pedal, the rear side of the insertion part protrudes backward relative to the second pedal, and when the second supporting leg is rotated backward in place relative to the first supporting leg, the rear side of the insertion part on the second pedal abuts against the bottom surface of the toilet seat ring for limiting.

Preferably, the bottom surface of the positioning socket cavity includes a front cavity bottom surface and a rear cavity bottom surface, both the front cavity bottom surface and the rear cavity bottom surface are inclined surfaces, the front positioning groove is set on the front cavity bottom surface, and the rear positioning groove is set on the rear cavity bottom surface; when the second supporting leg is inserted into the positioning socket cavity, the positioning bump vertically inserts into the front positioning groove; after the second supporting leg is rotated backward in place relative to the first supporting leg, the second pedal rotates relative to the second supporting leg, and the positioning bump on the bottom surface of the second supporting leg vertically inserts into the rear positioning groove for positioning.

Preferably, the rear side of the positioning socket cavity is an inclined surface, and when the second supporting leg is inserted into the positioning socket cavity, it fits tightly against the rear inclined surface for positioning.

Preferably, the front side and bottom surface of the second pedal both have recesses, and soft rubber pads are connected within the recesses.

Preferably, armrests are set on both left and right sides of the toilet seat ring.

This disclosure can be placed on the ground for young children to sit and use the toilet, or switched to be mounted on an adult toilet for young children to climb up and use. It can switch between usage states for young children to choose from.

Figure 1:
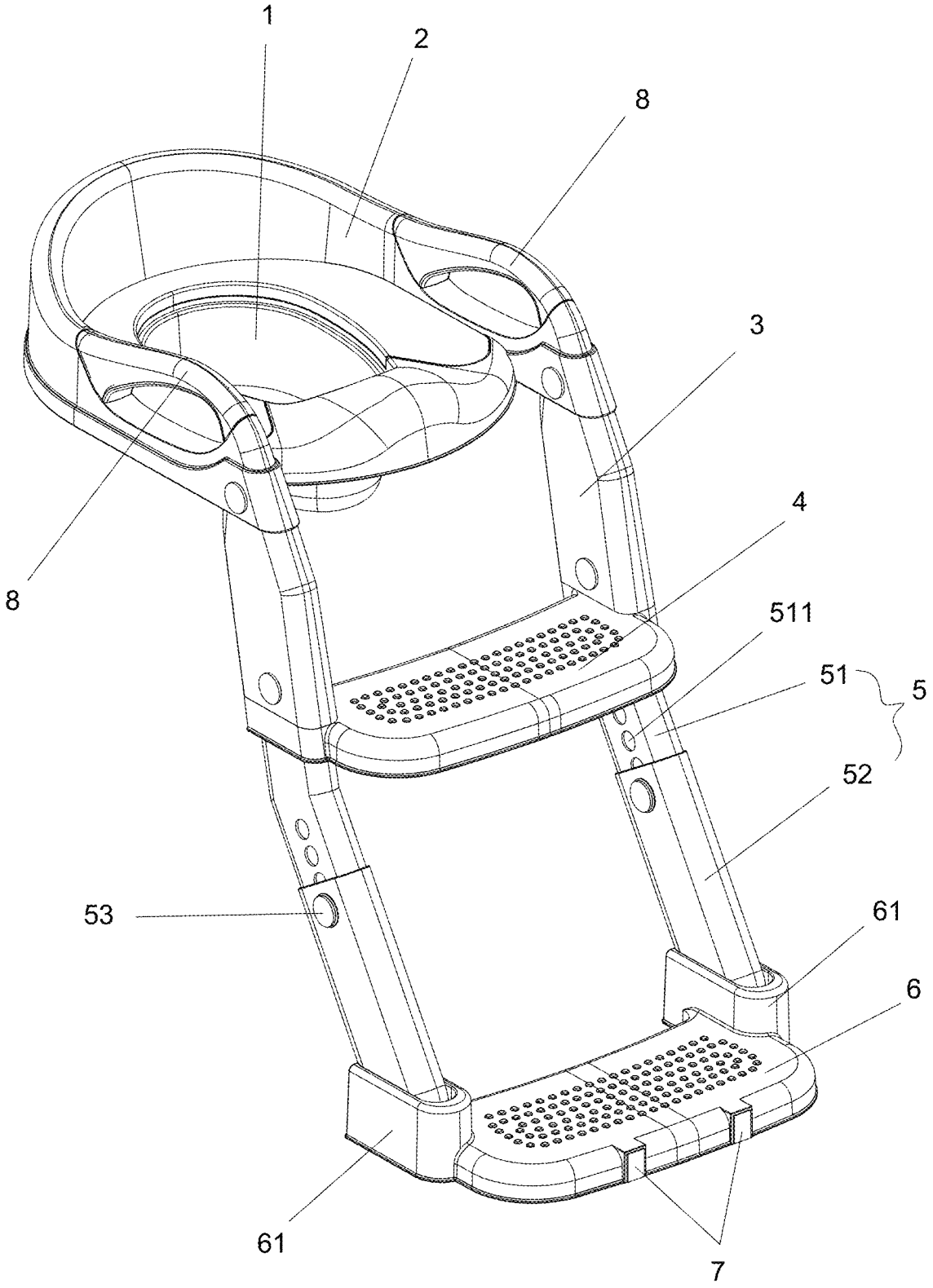
FIG. 1 is a structural diagram of this disclosure when unfolded.

Reference numerals: 1—potty; 2—toilet seat ring; 3—first supporting leg; 4—first pedal; 5—second supporting leg; 51—upper section of the supporting leg; 511—jack; 52—lower section of the supporting leg; 521—positioning bump; 53—pin shaft; 6—second pedal; 61—insertion part;

62—positioning socket cavity; 621—positioning protrusion; 622—positioning groove; 7—soft rubber pad; 8—armrest.

DETAILED DESCRIPTION OF THE EMBODIMENTS

The following is a further detailed explanation of this disclosure in conjunction with the figures.

Figure 2:
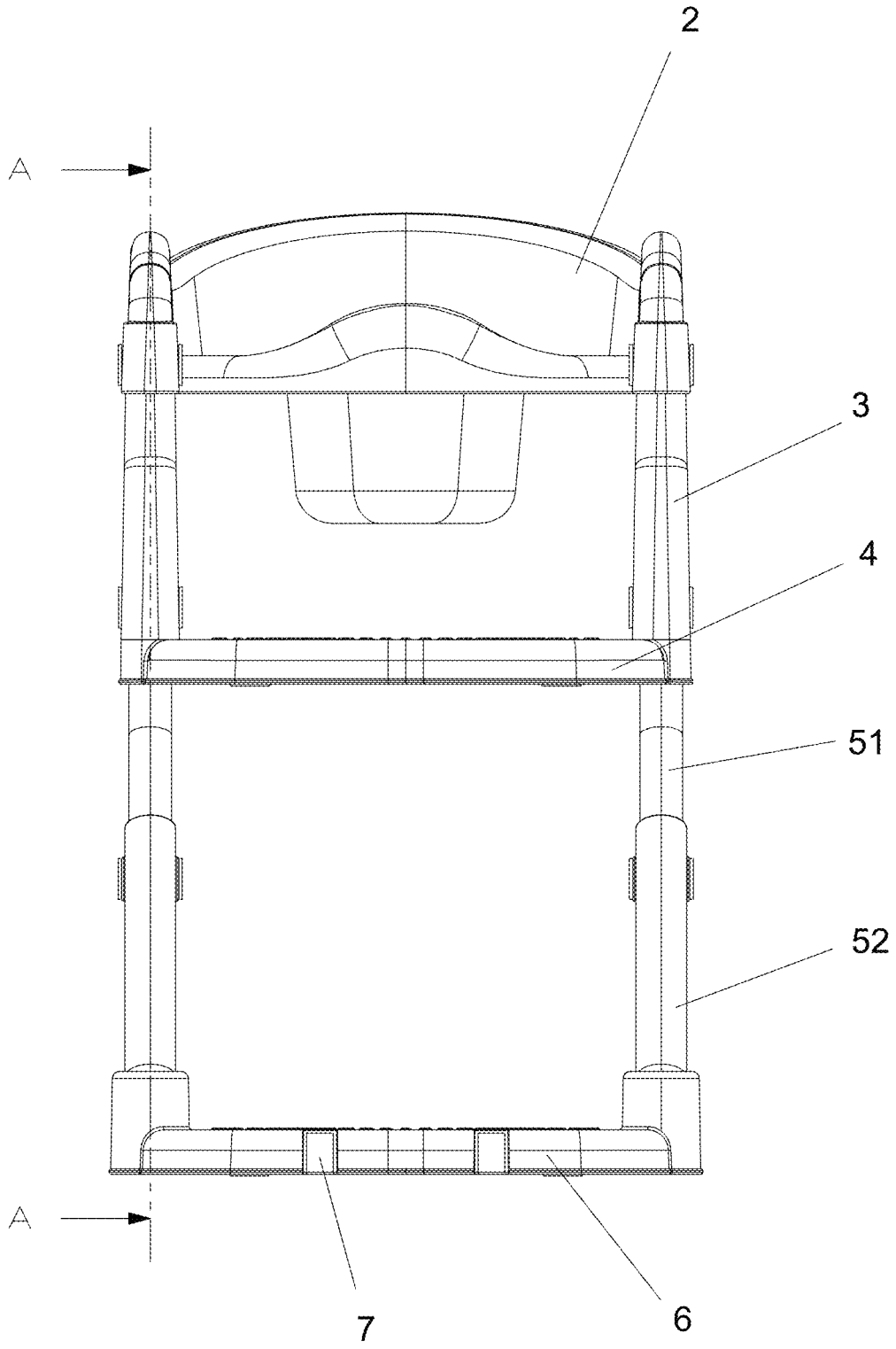
FIG. 2 is a front view of FIG. 1.
Figure 3:
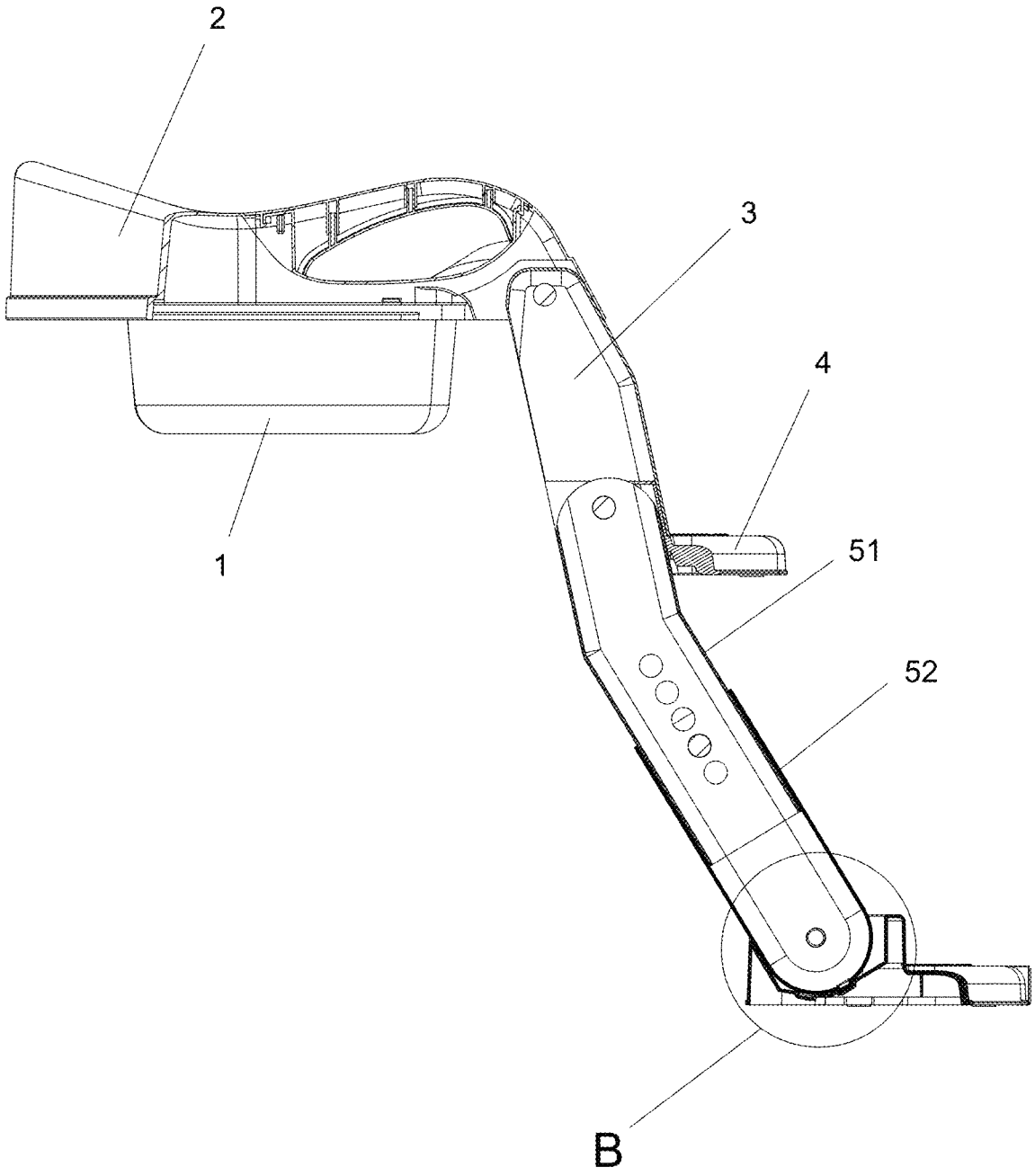
FIG. 3 is a sectional view along direction A-A in FIG. 2.
Figure 4:
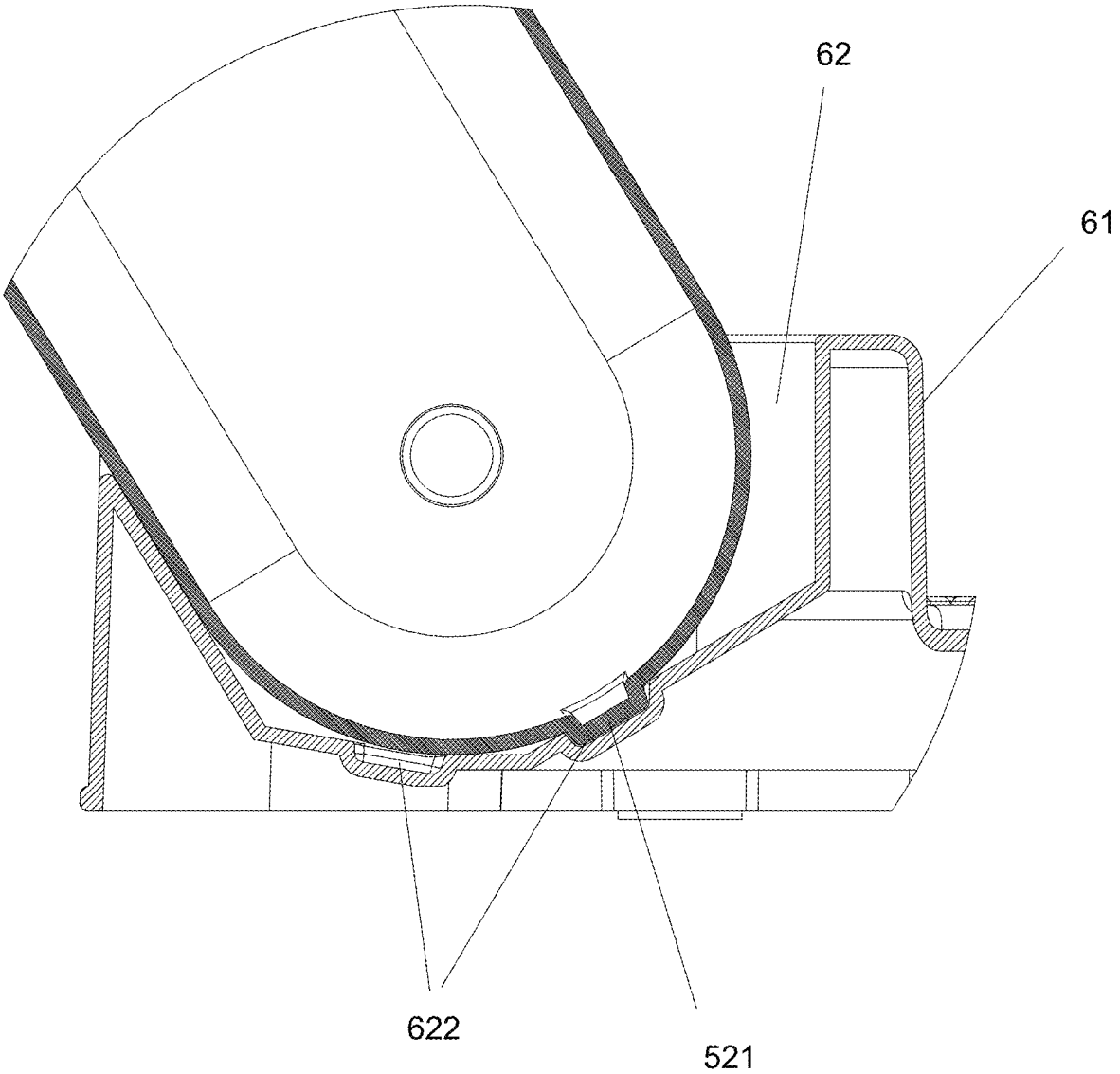
FIG. 4 is an enlarged partial view of area B in FIG. 3.
Figure 5:
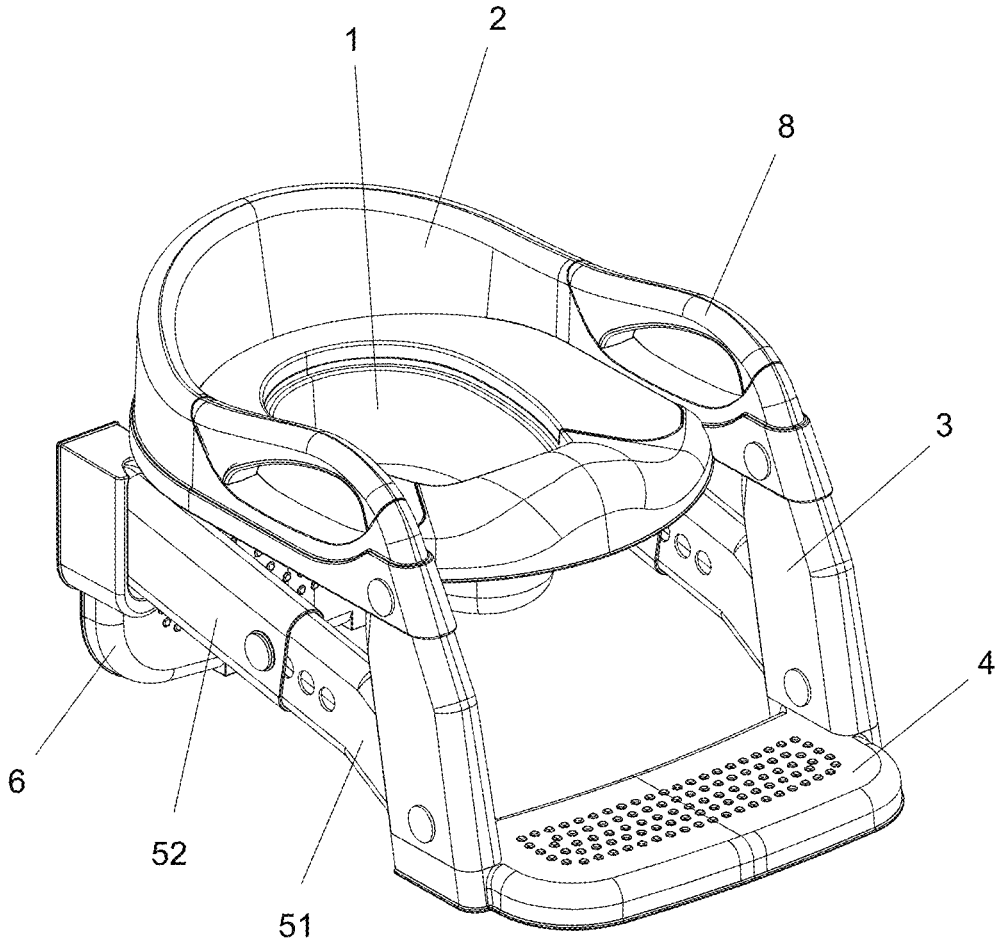
FIG. 5 is a structural diagram of this disclosure when folded.
Figure 6:
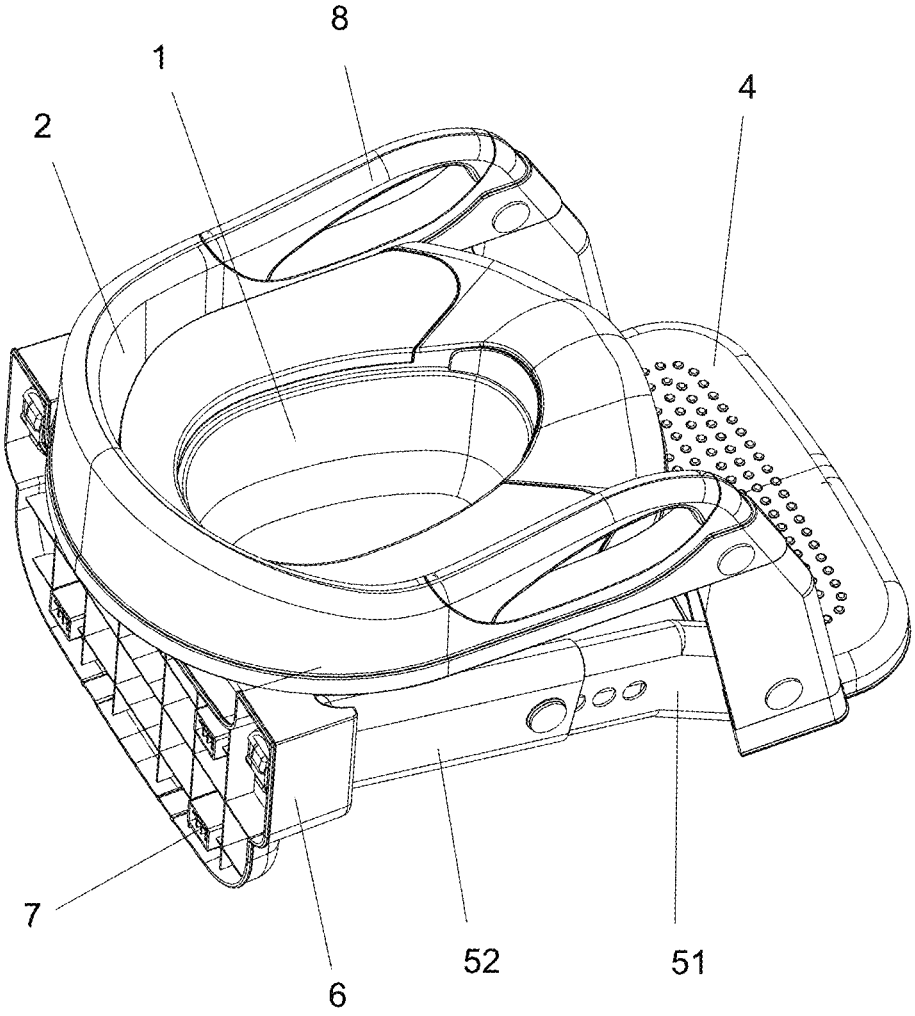
FIG. 6 is a structural diagram of this disclosure from another angle when folded.
Figure 7:
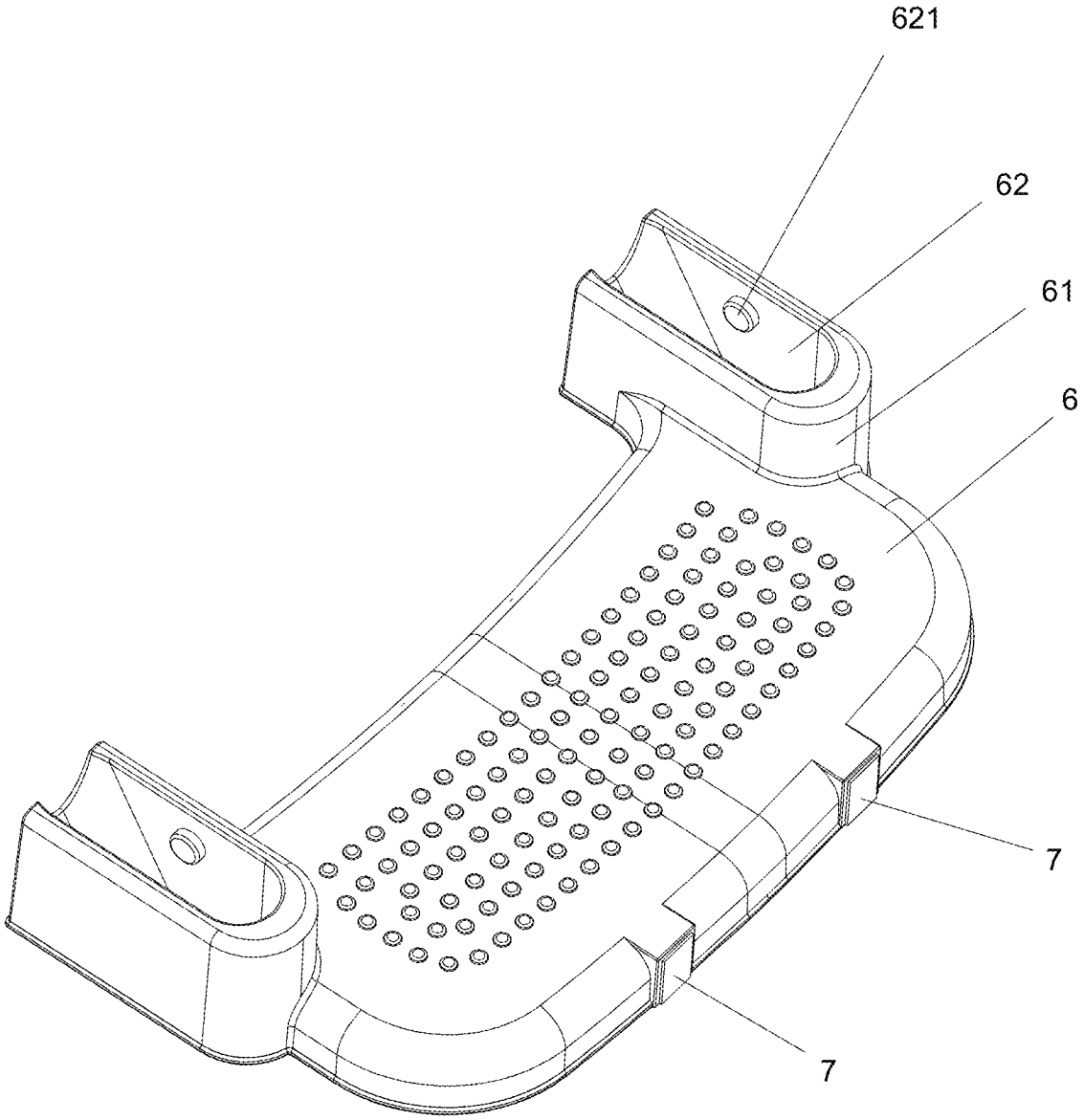
FIG. 7 is a structural diagram of the second pedal in this disclosure.

As shown in FIGS. 1 to 7, this disclosure provides a children's toilet trainer, including a toilet seat ring 2 that can hold a potty 1. The front end of the toilet seat ring 2 is connected to first supporting legs 3 on the left and right sides of the bottom surface. A first pedal 4 is connected between the bottom of the left and right first supporting legs 3. The bottom of the first supporting legs 3 is hinged to second supporting legs 5 and limits the forward rotation of the second supporting legs 5. A second pedal 6 is connected between the bottom of the left and right second supporting legs 5. When the second supporting legs 5 are rotated backward in place relative to the first supporting legs 3, one end of the second pedal 6 abuts against the bottom surface of the toilet seat ring 2 for positioning.

In the above solution, the second supporting leg 5 includes two parts: an upper section of the supporting leg 51 and a lower section of the supporting leg 52. The upper section of the supporting leg 51 has a series of jacks 511. The bottom of the upper section of the supporting leg 51 is inserted into the lower section of the supporting leg 52. The lower section of the supporting leg 52 has positioning holes set on the side. A pin shaft 53 is inserted through the positioning holes and jacks 511 to connect the upper section of the supporting leg 51 and lower section of the supporting leg 52 together. By adjusting the upper section of the supporting leg 51 and lower section of the supporting leg 52, the toilet trainer can be adapted to adult toilets of different heights.

Specifically, the top surface of the second pedal 6 extends outward on both sides to form insertion parts 61. The top surface of the insertion part 61 has a positioning socket cavity 62. Positioning protrusions 621 extend out from the left and right sides of the positioning socket cavity 62. The positioning socket cavity 62 has two positioning grooves 622 set front and back on the bottom surface; the bottom of the second supporting leg 5 has jacks corresponding to the positioning protrusions 621 set on both left and right sides, and the bottom surface of the second supporting leg 5 has a positioning bump 521. When the second supporting leg 5 is inserted into the positioning socket cavity 62, the positioning bump 521 inserts into the front positioning groove 622, ensuring that when the toilet trainer is mounted on an adult toilet, the second supporting leg remains in an extended state; after the second supporting leg 5 is rotated backward in place relative to the first supporting leg, the second pedal 6 rotates relative to the second supporting leg 5, and the positioning bump 521 on the bottom surface of the second supporting leg 5 inserts into the rear positioning groove 622 for positioning, ensuring that when the toilet trainer is folded, the second supporting leg remains in a folded state.

The insertion part is located at the rear end on both sides of the top surface of the second pedal, the rear side of the insertion part 61 protrudes backward relative to the second pedal 6, and when the second supporting leg 5 is rotated backward in place relative to the first supporting leg 3, the rear side of the insertion part 61 on the second pedal 6 abuts against the bottom surface of the toilet seat ring 2 for limiting. In this disclosure, the insertion part 61 is located at the rear end on both sides of the second pedal 6, so it does not obstruct the left and right sides of the second pedal. When the toilet trainer is mounted on an adult toilet for use, it allows children to easily climb up and down the toilet trainer from various directions.

The bottom surface of the positioning socket cavity 62 includes a front cavity bottom surface and a rear cavity bottom surface. Both the front cavity bottom surface and the rear cavity bottom surface are inclined surfaces. The front positioning groove 622 is set on the front cavity bottom surface, and the rear positioning groove 622 is set on the rear cavity bottom surface. When the second supporting leg 5 is inserted into the positioning socket cavity, the positioning bump 521 vertically inserts into the front positioning groove 622, with the second supporting leg perpendicular to and pressing against the front cavity bottom surface. This ensures that the positioning bump 521 will not easily come out of the front positioning groove 622. After the second supporting leg 5 is rotated backward in place relative to the first supporting leg, the second pedal rotates relative to the second supporting leg 5, and the positioning bump 521 on the bottom surface of the second supporting leg 5 vertically inserts into the rear positioning groove 622 for positioning, with the second supporting leg 5 perpendicular to and pressing against the rear cavity bottom surface. This ensures that the positioning bump 521 will not easily come out of the rear positioning groove 622. Therefore, this disclosure maintains a stable connection whether mounted on an adult toilet or folded and placed on the ground. It should also be noted that the inclination angles of the front cavity bottom surface and rear cavity bottom surface depend on the forward tilt angle of the second supporting leg 5.

Furthermore, the rear side of the positioning socket cavity 62 is an inclined surface, and when the second supporting leg 5 is inserted into the positioning socket cavity 62, it fits tightly against the rear inclined surface for positioning. When the toilet trainer is mounted on an adult toilet for use, the tight fit between the side wall of the second supporting leg and the rear inclined surface of the positioning socket cavity 62 provides more stable support for the toilet trainer's supporting legs.

Additionally, the front side and bottom surface of the second pedal 6 both have recesses, and soft rubber pads 7 are connected within the recesses. When this utility model is in either unfolded or folded state, the parts in contact with the ground are all soft rubber pad 7 sections.

Moreover, the top surfaces of both the first pedal and second pedal are equipped with anti-slip particles.

Furthermore, armrests 8 are set on both left and right sides of the toilet seat ring.

This disclosure provides two usage states: one is mounted on an adult toilet for young children to climb up and use, and after folding, it can be placed on the ground for young children to sit and use. It can be quickly switched between states, convenient for children of different age groups to choose from.

The above description is only a preferred embodiment of this disclosure and does not impose any form of limitation on the disclosure. Any simple modifications, equivalent changes or alterations made to the above embodiments based on the technical principles of this disclosure still fall within the scope of the technical solution of this disclosure.

The invention claimed is:

1. A children's toilet trainer, comprising:

a toilet seat ring (2) that can hold a potty (1), the toilet seat ring (2) comprising two open ends, each having a bottom surface facing away from a child when the child sits on the toilet seat ring (2), wherein the bottom surface of each of the two open ends of the toilet seat ring (2) is connected to a respective first supporting legs, a first pedal (4) is connected between the two first supporting legs, at a bottom of the two first supporting legs, the bottom of each of the two first supporting legs (3) is hinged to a respective second supporting leg (5) and limits a forward rotation of the respective second supporting leg (5), a second pedal (6) is connected between the two second supporting legs (5), at a bottom of the two second supporting legs (5);

when the two second supporting legs (5) are rotated backward in place relative to the two first supporting legs (3), one end of the second pedal (6) abuts against the bottom surface of the toilet seat ring (2) for positioning.

2. The children's toilet trainer according to claim 1, wherein:

each of the two second supporting legs (5) includes two parts:

an upper section of each supporting leg (51) and a lower section of each supporting leg (52), the upper section of the supporting leg (51) has a series of jacks (511), the bottom of the upper section of the supporting leg (51) is inserted into the lower section of the supporting leg (52), the lower section of the supporting leg (52) has positioning holes set on the side, a pin shaft (53) is inserted through the positioning holes and jacks (511) to connect the upper section of the supporting leg (51) and lower section of the supporting leg (52) together.

3. The children's toilet trainer according to claim 1, wherein:

a top surface of the second pedal (6) extends outward on both sides to form insertion parts (61), a top surface of the insertion part (61) has a positioning socket cavity (62), positioning protrusions (621) extend out from the left and right sides of the positioning socket cavity (62), the bottom surface of the positioning socket cavity (62) has two positioning grooves (622) set front and rear;

the bottom of the second supporting leg (5) has jacks corresponding to the positioning protrusions (621) set on both left and right sides, and the bottom surface of the second supporting leg (5) has a positioning bump (521), wherein the second supporting leg (5) is configured to be inserted into the positioning socket cavity (62), such that the positioning bump (521) is capable of inserting into the front positioning groove (622), wherein after the second supporting leg (5) is rotated backward in place relative to the first supporting leg (3), the second pedal (6) is configured to rotate relative to the second supporting leg (5), and the positioning bump (521) on the bottom surface of the second supporting leg (5) is configured to insert into the rear positioning groove (622) for positioning.

4. The children's toilet trainer according to claim 3, wherein:

the insertion part (61) is located at the rear end on both sides of the top surface of the second pedal, the rear side of the insertion part (61) protrudes backward relative to the second pedal (6), and when the second supporting leg (5) is rotated backward in place relative to the first supporting leg (3), the rear side of the insertion part (61) on the second pedal (6) abuts against the bottom surface of the toilet seat ring (2) for limiting.

5. The children's toilet trainer according to claim 3, wherein:

the bottom surface of the positioning socket cavity (62) includes a front cavity bottom surface and a rear cavity bottom surface, both the front cavity bottom surface and the rear cavity bottom surface are inclined surfaces, the front positioning groove (622) is set on the front cavity bottom surface, and the rear positioning groove (622) is set on the rear cavity bottom surface;

when the second supporting leg is inserted into the positioning socket cavity, the positioning bump (521) vertically inserts into the front positioning groove (622);

after the second supporting leg (5) is rotated backward in place relative to the first supporting leg (3), the second pedal is configured to rotate relative to the second supporting leg (5), and the positioning bump (521) on the bottom surface of the second supporting leg (5) is configured to vertically insert into the rear positioning groove (622) for positioning.

6. The children's toilet trainer according to claim 3, wherein:

the rear side of the positioning socket cavity (62) is an inclined surface, and when the second supporting leg (5) is inserted into the positioning socket cavity (62), it fits against the rear inclined surface for positioning.

7. The children's toilet trainer according to claim 3, wherein:

the front side and bottom surface of the second pedal (6) both have recesses, and soft rubber pads (7) are connected within the recesses.

8. The children's toilet trainer according to claim 3, wherein:

armrests (8) are set on both left and right sides of the toilet seat ring (2).

* * * * *